US009191757B2

(12) United States Patent
Bauman et al.

(10) Patent No.: US 9,191,757 B2
(45) Date of Patent: Nov. 17, 2015

(54) HEARING AID WITH INDUCTIVELY COUPLED ELECTROMAGNETIC RESONATOR ANTENNA

(71) Applicant: Starkey Laboratories, Inc., Eden Prairie, MN (US)

(72) Inventors: Brent Bauman, Eden Prairie, MN (US); Jorge F. Sanguino, Hopkins, MN (US); Greg Haubrich, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 66 days.

(21) Appl. No.: 13/939,791

(22) Filed: Jul. 11, 2013

(65) Prior Publication Data

US 2015/0016645 A1 Jan. 15, 2015

(51) Int. Cl.
*H04R 25/00* (2006.01)

(52) U.S. Cl.
CPC ..... *H04R 25/554* (2013.01); *H04R 2225/51* (2013.01)

(58) Field of Classification Search
CPC ..... H04R 25/60; H04R 25/65; H04R 25/70; H04R 25/356; H04R 25/456; H04R 25/505; H04R 25/552; H04R 25/558; H04R 25/604; H04R 25/652; H04R 25/658; H04R 2225/025; H04R 2225/41; H04R 2225/61
USPC ..... 381/312, 315, 322, 324, 328, 330
See application file for complete search history.

(56) References Cited

U.S. PATENT DOCUMENTS

| | | | | |
|---|---|---|---|---|
| 8,035,255 | B2 | 10/2011 | Kurs et al. | |
| 8,180,080 | B2 * | 5/2012 | Polinske | 381/315 |
| 2004/0124840 | A1 | 7/2004 | Reykowski | |
| 2005/0111681 | A1 * | 5/2005 | Essabar | 381/315 |
| 2005/0244024 | A1 * | 11/2005 | Fischer et al. | 381/331 |
| 2007/0080889 | A1 | 4/2007 | Zhang | |
| 2008/0272980 | A1 | 11/2008 | Adel et al. | |
| 2010/0171370 | A1 | 7/2010 | Karalis et al. | |
| 2010/0181844 | A1 | 7/2010 | Karalis et al. | |
| 2010/0259108 | A1 | 10/2010 | Giler et al. | |
| 2010/0321269 | A1 * | 12/2010 | Ishibana et al. | 343/834 |
| 2011/0142270 | A1 | 6/2011 | Niederdrank | |
| 2012/0041298 | A1 | 2/2012 | Mersky | |

(Continued)

FOREIGN PATENT DOCUMENTS

WO WO-2012092973 A1 7/2012

OTHER PUBLICATIONS

"Grundig AN200 AM Indoor Antenna", Universal-Radio Inc., [Online]. Retrieved from the Internet: <URL: http://www.universal-radio.com/catalog/mwant/0912.html>, (Accessed: Nov. 11, 2014), 1 pgs.

(Continued)

*Primary Examiner* — Brian Ensey
(74) *Attorney, Agent, or Firm* — Schwegman Lundberg & Woessner, P.A.

(57) ABSTRACT

A hearing aid includes an antenna for wireless communication with another device. The antenna includes a primary element connected to the circuit of the hearing aid and one or more secondary elements parasitically coupled to the primary element. This antenna configuration substantially increases radiation efficiency when compared to an antenna with the primary element alone, without substantially increasing the size, power consumption, and complexity of the hearing aid.

28 Claims, 10 Drawing Sheets

(56) References Cited

U.S. PATENT DOCUMENTS

| | | | | |
|---|---|---|---|---|
| 2012/0087506 | A1 | 4/2012 | Ozden | |
| 2012/0093324 | A1 * | 4/2012 | Sinasi | 381/322 |

OTHER PUBLICATIONS

"Select-A-Tenna Regular Model", Amazon, http://www.amazon.com/Select-A-Tenna-Regular-Model/dp/B0015A81HI/ref=cm_cr_pr_pb_t, (Accessed: Nov. 11, 2014), 5 pgs.

Allen, Jay, "Two Popular AM Loop Antennas: Select-A-Tenna vs. Terk AM Advantage", Radio Intel, [Online]. Retrieved from the Internet: <URL: http://www.radiointel.com/review-2loop.htm>, (Accessed: Nov. 11, 2014), 6 pgs.

Chang, Kihun, et al., "A triple-band printed dipole antenna using parasitic elements", Wiley Online Library, [Online]. Retrieved from the Internet: <URL: http://onlinelibrary.wiley.com/doi/10.1002/mop.21129/abstract>, (Accessed: Nov. 11, 2014), 2 pgs.

Zhang, Jiaying, et al., "Self-Resonant Electrically Small Loop Antennas for Hearing-Aids Application", Antennas and Propagation (EuCAP), Proceedings of the Fourth European Conference on, (2010), 5 pgs.

"European Application Serial No. 14176626.1, Extended European Search Report mailed Dec. 15, 2014", 7 pgs.

* cited by examiner

HEARING AID WITH INDUCTIVELY COUPLED ELECTROMAGNETIC RESONATOR ANTENNA

TECHNICAL FIELD

This document relates generally to hearing assistance systems and more particularly to a hearing aid that includes an inductively coupled electromagnetic resonator antenna for wireless communication with another device.

BACKGROUND

Hearing aids are used to assist patients suffering hearing loss by transmitting amplified sounds to ear canals. The sounds may be detected from a patient's environment using the microphone in a hearing aid and/or received from a streaming device via a wireless link. Wireless communication may also be performed for programming the hearing aid and receiving information from the hearing aid. In one example, a hearing aid is worn in and/or around a patient's ear. Patients generally prefer that their hearing aids are minimally visible or invisible, do not interfere with their daily activities, and easy to maintain. One difficulty in miniaturizing a hearing aid is associated with providing the hearing aid with reliable wireless communication capabilities. Given the reduced space, likely accompanied with reduced power supply and increased interference from other metal parts of the hearing aid, there is a need for providing the hearing aid with a wireless communication system that is small in size and highly power-efficient, and maintains a reliable wireless link in noisy radio frequency situations.

SUMMARY

A hearing aid includes an antenna for wireless communication with another device. The antenna includes a primary element connected to the circuit of the hearing aid and one or more secondary elements parasitically coupled to the primary element. This antenna configuration substantially increases radiation efficiency when compared to an antenna with the primary element alone, without substantially increasing the size, power consumption, and complexity of the hearing aid.

In one embodiment, a hearing aid is capable of performing wireless communication with another device and includes a case, a hearing aid circuit housed in the case, and an antenna. The hearing aid circuit is configured to perform the wireless communication. The antenna includes a primary antenna element and one or more secondary antenna elements. The primary antenna element is electrically connected (e.g., wired) to the hearing aid circuit. The one or more secondary antenna elements are each parasitically coupled to the primary antenna element. In various embodiments, the one or more secondary antenna elements are incorporated into the case, housed in the case and wrapped around the hearing aid circuit, or formed on a flexible circuit substrate.

In one element, a method is provided for transmitting a signal from a hearing aid using wireless communication. A radio frequency (RF) carrier is modulated using the signal. A first energy representing the modulated radio frequency carrier is radiated from a primary antenna element housed in a case of the hearing aid. The first energy is received using one or more secondary antenna elements incorporated into the case of the hearing aid. A second energy representing the modulated radio frequency carrier is radiated from the one or more second antenna elements.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
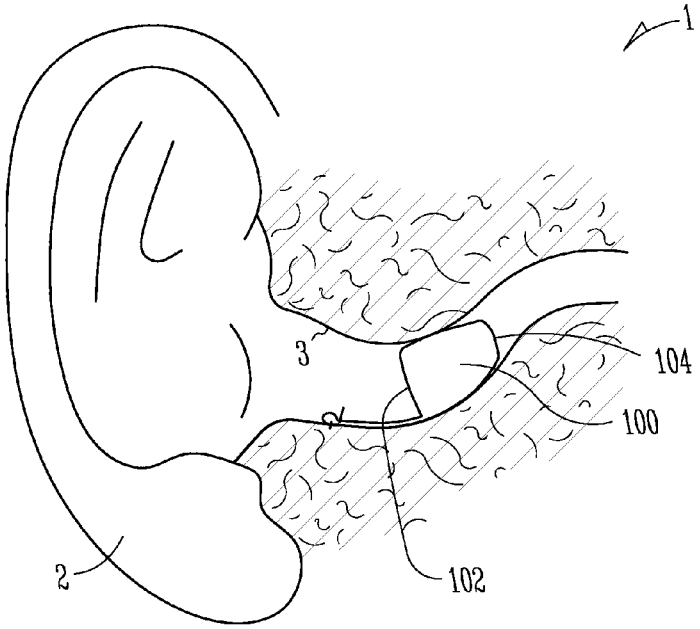
FIG. 1 is an illustration of an embodiment of a hearing aid and portions of an environment in which the hearing aid is used.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses an apparatus and method for increasing radiation efficiency of an antenna in a hearing assistance device with wireless communication capabilities. Examples of the hearing assistance device include hearing aids. Due to the limited space and batter power available in a hearing aid, a power-efficient antenna system for the wireless communication is needed. An invisible-in-the canal (IIC) hearing aid, for example, may sit deeply in an ear canal of the hearing aid wearer. Head loading, head shadowing, space constrictions, and low power transceivers used in the IIC hearing aid each limit power to be transmitted to an external device a distance away to a certain degree. Because the antenna of the IIC hearing aid is placed in close proximity of other metal parts (such as the receiver, battery, microphone, connecting wires, and flexible circuit of the hearing aid), its radiation properties deteriorates due to the interactions with such metal parts. Size and power restrictions prevent improvement of the antenna's radiation efficiency by increasing its size and/or power consumption.

The present subject matter provides a hearing aid with an antenna that includes one or more secondary antenna elements parasitically coupled to a primary antenna element to increase the radiation efficiency as compared to using the primary antenna element alone. The one or more secondary antenna elements include electromagnetic resonators inductively coupled to the primary element, which is electrically connected to the circuitry of the hearing aid. Each secondary antenna element is configured to provide gain and/or bandwidth in addition to what the primary antenna element has provided. The parasitic coupling eliminates the need for direct conductive contacts between the antenna elements, thereby eliminates interconnection conductors and/or connectors and their associated reliability issues.

While the antenna with one primary element and one or more secondary antenna elements are specifically discussed as an example for illustrative purposes, the antenna in various embodiments may include any number of primary and secondary antenna elements based on design considerations. For example, multiple primary elements may be used to further increase the radiation efficiency of the antenna.

In one embodiment, the one or more secondary antenna elements are integrated with the case (shell) of the hearing aid and inductively coupled to the primary antenna element. In another embodiment, the one or more secondary antenna elements are wrapped around a portion of circuitry of the hearing aid and inductively coupled to the primary antenna element. In another embodiment, the one or more secondary antenna elements are integrated onto a layer of a flexible circuit of the hearing aid, and the primary element is integrated onto another layer of the flexible circuit, or another flexible circuit of the hearing aid, and coupled to the one or more secondary antenna element through the dielectric between the layers of the flexible circuit, or between the flexible circuits.

In various embodiments, the present system matter improves radiation efficiency of the antenna for a more reliable wireless communication link without substantially increasing the size, cost of manufacturing, and parts count of the hearing aid. The impedance match between a high-impedance differential amplifier and a-low impedance antenna can be better achieved to increase power output from the antenna. The antenna can also have an increased rejection filtering response, and can be less susceptible to out of band interference. Out of band rejection response also reduces radiated harmonics generated by the radio circuit of the hearing aid. If the one or more secondary antenna elements are weakly coupled to the primary antenna element, port impedance seen from the primary antenna element will be constant when the antenna is in free space or worn on the body. Antenna elements such as wire loops can also be tuned to different frequencies so that the antenna can function as a frequency selective antenna.

The present subject matter may be particularly useful in small hearing aids such as IIC, completely-in-the canal (CIC), in-the-canal (ITC), and in-the-ear (ITE) type hearing aids. However, as most hearing aid wearers may prefer their hearing aids to be small in size and low in power consumption, the present subject matter may also be applied in behind-the-ear (BTE), or receiver-in-canal (RIC) type hearing aids. Thus, the present subject matter is demonstrated for hearing assistance devices, including hearing aids, including but not limited to, IIC, CIC, ITC, ITE, BTE, or RIC type hearing aids. It is understood that BTE type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to RIC or receiver-in-the-ear (RITE) designs. The present subject matter can also be used in hearing assistance devices generally, such as cochlear implant type hearing devices or wireless ear buds. It is understood that other hearing assistance devices not expressly stated herein may be used in conjunction with the present subject matter.

FIG. 1 is an illustration of an embodiment of a hearing aid 100 and portions of an environment in which hearing aid 100 is used. Hearing aid 100 is illustrated as an IIC hearing aid that is substantially invisible after being properly inserted in an ear canal, in its intended operational position. As illustrated, an ear 1 includes a pinna 2 and an ear canal 3, and hearing aid 100 is placed in ear canal 3. Hearing aid 100 has a rear end 102 and a front end 104. Front end 104 enters ear canal 3 first when hearing aid 100 is being inserted for its intended use. In one embodiment, hearing aid 100 is tapered, with front end 104 being smaller than rear end 102, for ease of insertion. The IIC hearing aid is illustrated as a specific example in this document, while the present subject matter can be applied to any type hearing aids and other hearing assistance devices. In various embodiments, hearing aid 100 includes an antenna for wireless communication with one or more other devices such as a programmer, a streaming device, and/or another hearing aid. The antenna includes parasitically coupled elements as further discussed with reference to FIGS. 2-9.

Figure 2:
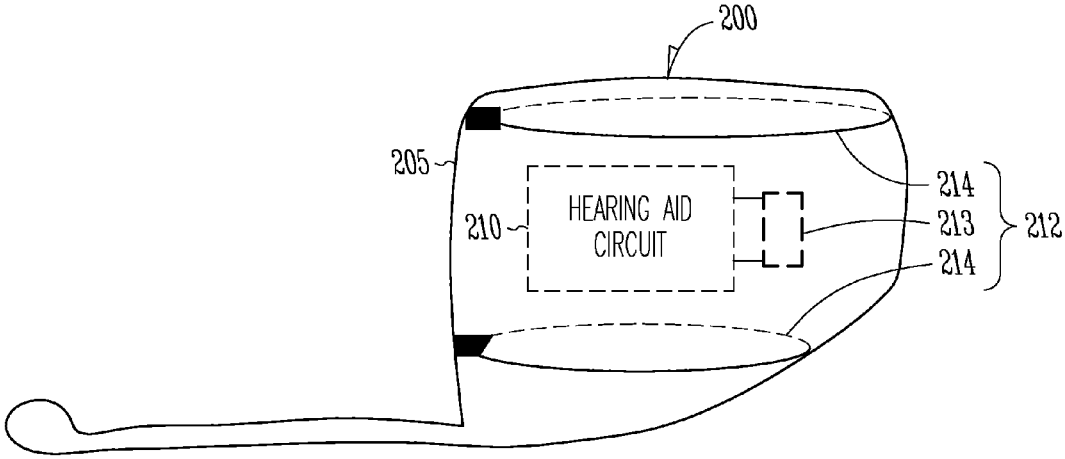
FIG. 2 is an illustration of an embodiment of the hearing aid.

FIG. 2 is an illustration of an embodiment of a hearing aid 200. Hearing aid 200 represents an example of hearing aid 100 and includes case 205, a hearing aid circuit 210 housed in case 205, and an antenna 212 that is connected to hearing aid circuit 210. Case 205 may include a plastic earmold. In the illustrated embodiment, antenna 212 includes a primary antenna element 213 and two secondary antenna elements 214. Primary antenna element 213 is housed in case 205 and electrically connected (e.g., wired) to hearing aid circuit 210. Secondary antenna elements 214 are accommodated in case 205 and parasitically coupled to primary antenna element 213. In various embodiments, antenna 212 includes primary antenna element 213 and one or more secondary antenna elements 214. The one or more secondary antenna elements 214 are each attached to or embedded in case 205, or otherwise partially or wholly housed in or attached to case 205, and electrically or parasitically coupled to primary antenna element 213.

Figure 3:
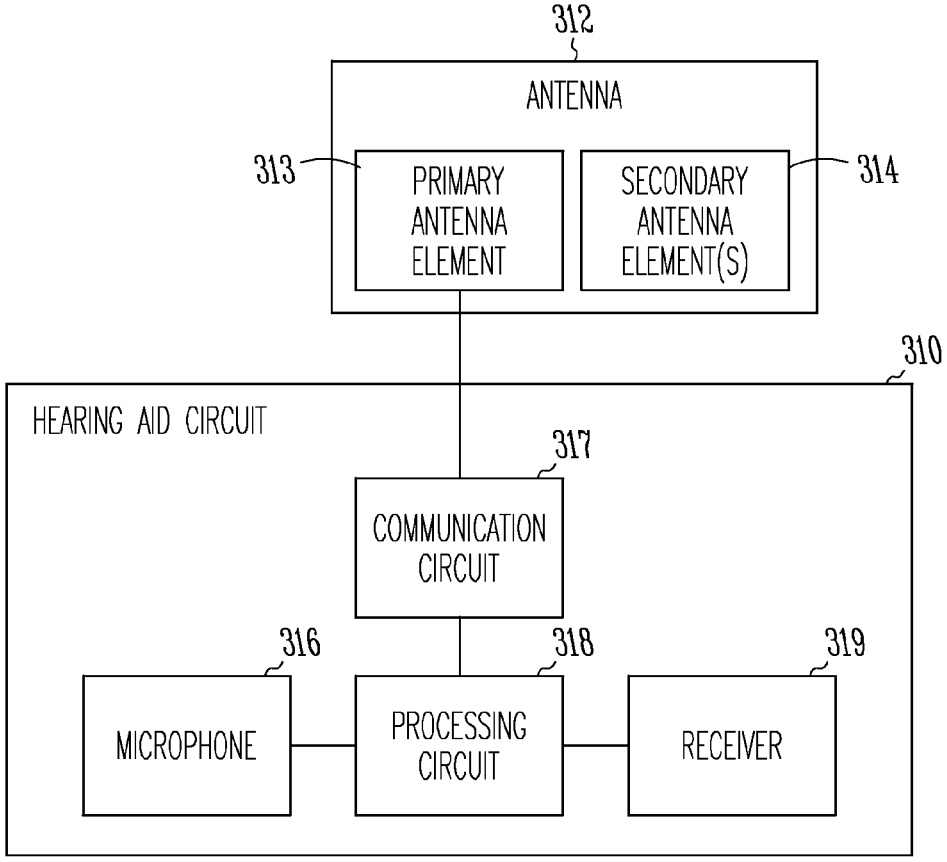
FIG. 3 is a block diagram illustrating an embodiment of portions of a circuit of the hearing aid.

FIG. 3 is a block diagram illustrating an embodiment of a hearing aid circuit 310 and an antenna 312. Hearing aid circuit 310 represents an example of portions of hearing aid circuit 210 and includes a microphone 316, a communication circuit 317, a processing circuit 318, and a receiver (speaker) 319. Microphone 316 receives sounds from the environment of the hearing aid wearer (wearer of hearing aid 100). Communication circuit 317 communicates with another device wirelessly, including receiving programming codes, streamed audio signals, and/or other audio signals and transmitting programming codes, audio signals, and/or other signals. Processing circuit 318 controls the operation of hearing aid using the programming codes and processes the sounds received by microphone 316 and/or the audio signals received by communication circuit 317 to produce output sounds. Receiver 319 transmits output sounds to an ear canal of the hearing aid wearer.

Antenna 312 includes a primary antenna element 313 and one or more secondary antenna elements 314. Primary antenna element 313 is electrically coupled (e.g., wired) to communication circuit 317. Secondary antenna elements 214 as shown in FIG. 2 represent an embodiment of secondary antenna element(s) 314 incorporated into the case of the hearing aid.

Figure 4:
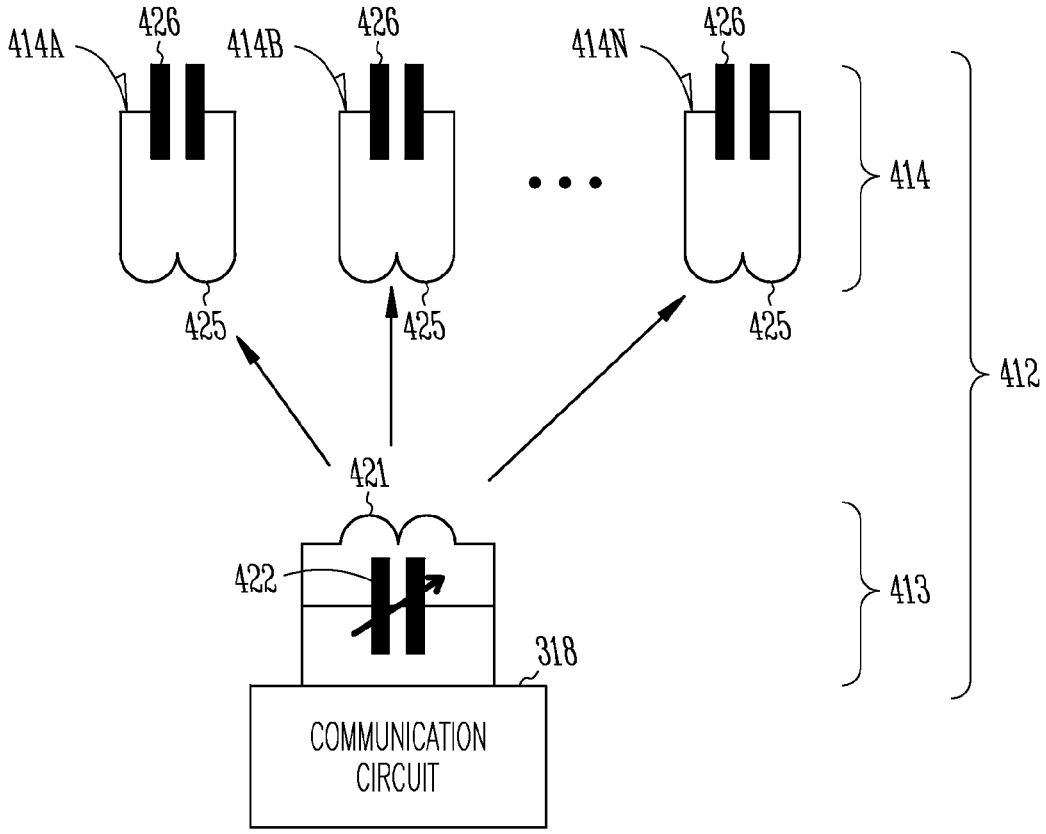
FIG. 4 is a circuit/block diagram illustrating an embodiment of an antenna coupled to a communication circuit of the hearing aid.

FIG. 4 is a circuit/block diagram illustrating an embodiment of an antenna 412 coupled to communication circuit 318. Antenna 412 represents an embodiment of a circuit for antenna 312 and includes a primary antenna element 413 and secondary antenna elements 414. While illustrated in FIG. 4 as a plurality of elements 414A-N, secondary antenna element(s) 414 may include any number of antenna elements in various embodiments. Antenna 212 as shown in FIG. 2 represents an embodiment of antenna 414 incorporated into a hearing aid.

Primary antenna element 413 is a near field electromagnetic coupling element that is configured to parasitically energize secondary antenna elements 414. Primary antenna element 413 represents an example of the circuit for primary antenna element 313 and, in the illustrated embodiment, includes a radiation element illustrated as an inductor 421 and a tuning element illustrated as a capacitor 422. In one embodiment, capacitor 422 has a programmable or otherwise adjustable capacitance. Secondary antenna elements 414 are passive electromagnetic resonant repeaters or electric resonant repeaters. Secondary antenna element(s) 414 represent an embodiment of a circuit for secondary antenna element(s) 314 and, in the illustrated embodiment, each include a radiation element illustrated as an inductor 425 and a tuning element illustrated as a capacitor 426. Primary antenna element 413 and secondary antenna elements are configured and placed such that the total electromagnetic energy emitted from the hearing aid using antenna 412 is substantially greater than the electromagnetic energy emitted from primary antenna element 413 alone. In one embodiment, primary antenna element 413 and secondary antenna elements are configured to reduce effects of human body loading on antenna 412 such that the total electromagnetic energy emitted from the hearing aid using antenna 412 is greater when the hearing aid is worn in its operational position on the head of the hearing aid wearer than when the hearing aid in a standalone position in free space.

For the purpose of discussion in this document, inductor 421 represents the radiation element of primary antenna element 413 regardless of whether the radiation element is effectively an inductive structure; inductor 425 represents the radiation element of secondary antenna elements 414 regardless of whether the radiation element is effectively an inductive structure; capacitor 422 represents the tuning element of primary antenna element 413 regardless of whether the tuning element is effectively a capacitive structure; and capacitor 426 represents the tuning element of secondary antenna element 414 regardless of whether the tuning element is effectively a capacitive structure.

In various embodiments, primary antenna element 413 interacts with secondary antenna element(s) 414 with near field electromagnetic energy. Secondary antenna element(s) 414 receive(s) the energy and reradiate a larger amount of that energy into the far field. Thus, antenna 412 radiates a larger amount of energy as compared to a single primary antenna element 413. In various embodiments, antenna 412 is constructed to increase the radiation property of a single primary antenna element 413 while maintaining the small package size restrictions required for the hearing aid. This provides the hearing aid with reliable wireless communication over a desirable range while maintaining the needed miniature package size required for small hearing aids such as the IIC hearing aid.

In one embodiment, secondary antenna elements 414 each have a standalone resonant frequency higher or lower than the resonant frequency of primary antenna element 413 by a specified offset. This allows margin for resonance of secondary antenna elements 414 to increase bandwidth and/or shift frequency toward resonance of the primary antenna element 414, thereby increasing the total amount of power radiated from the hearing aid when the hearing aid is placed in its operational position on the right or left side of the hearing aid wearer's head. In one embodiment, the offset is specified to cause a weak near field coupling that makes the impedance of (seen by looking into) primary antenna element 413 remain substantially unchanged when secondary antenna element are brought into close proximity of primary antenna element 413. This allows tuning capacitor 422 to create a desired resonant frequency that remains substantially unchanged when secondary antenna elements 414 are inductively coupled to primary antenna element 413.

In one embodiment, secondary antenna elements 414 each have a standalone resonant frequency different from the resonant frequency of primary antenna element 413 by a specified offset. This allows the secondary antenna elements 414 to increase the radiation efficiency of antenna 412 as compared to using primary antenna element 413 alone while increasing the bandwidth of antenna 412 as compared to using a single resonant frequency for the primary and secondary antenna elements. The offsets associated with secondary antenna elements 414 may be substantially identical or different from each other, and may be determined based on the desirable bandwidth for antenna 412. In various embodiments, two or more secondary antenna elements 414 can be parasitically coupled to primary antenna element 413 and to each other to provide antenna 412 with greater operational bandwidth and/or increased efficiency over a set amount of bandwidth. In one embodiment, secondary antenna elements 414 are functionally arranged into a plurality of groups having substantially different standalone resonant frequencies. Each group includes one or more elements of secondary antenna elements. This allows the hearing aid to perform the wireless communication using substantially different frequency bands each with a bandwidth and radiation efficiency that may be set and/or adjusted using tuning capacitor 422 of primary antenna element 413. In one embodiment, each group of secondary antenna elements 414 includes elements tuned to substantially different standalone resonant frequencies to increase the operational bandwidth of the group. The offset in the resonant frequency associated with each element within a group may be small when compared to the resonant frequency of the group.

The quality factor (referred to as the "Q factor" or "Q") of each of primary antenna element 413 and secondary antenna elements 414 affects the radiation efficiency and bandwidth of antenna 412. For example, increasing Q of one or more of secondary antenna elements 414 results in increased radiation efficiency and decreased bandwidth. In one embodiment, the bandwidth of antenna 412 is increased by increasing the count of secondary antenna elements 414 and/or lowering the overall Q of secondary antenna elements 414.

Figure 5A:
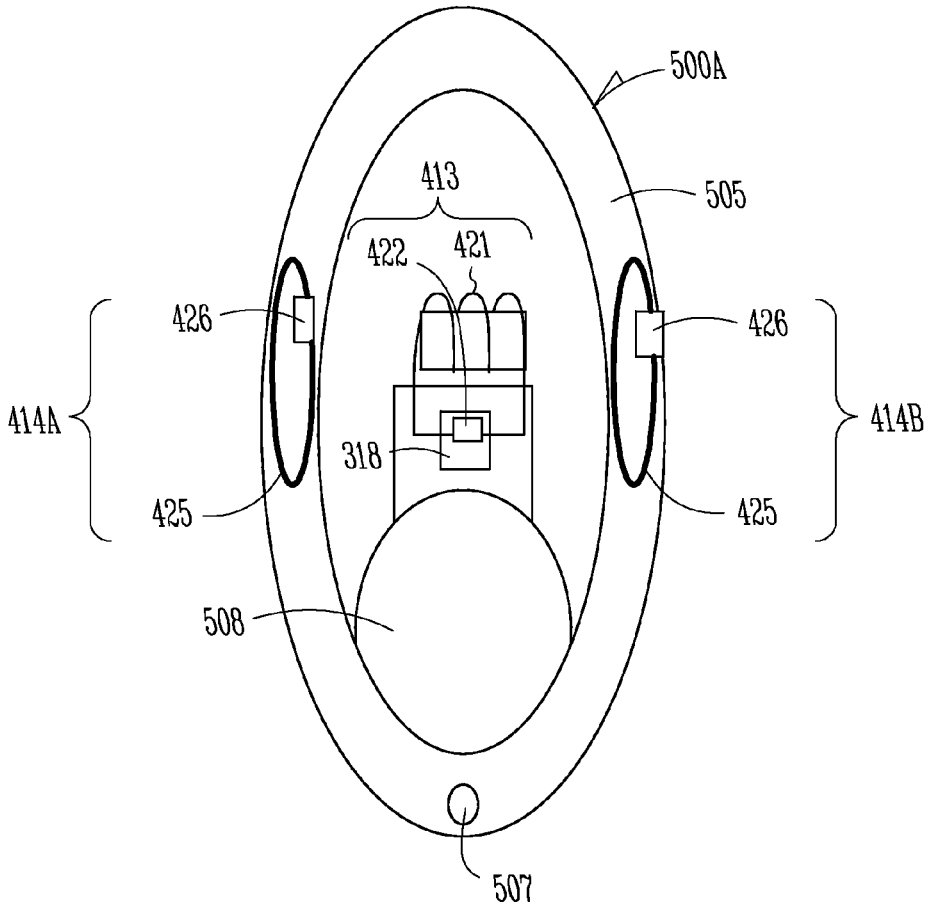
FIG. 5A is an illustration of an embodiment of the antenna and communication circuit of FIG. 4.

FIG. 5A is an illustration of an embodiment of antenna 412 and communication circuit 318 housed in a case 505 of a hearing aid 500A. Hearing aid 500A represents an embodiment of hearing aid 100. In various embodiments, case 505 may include a plastic earmold casing custom made for an IIC, CIC, ITC, ITE, or other type hearing aid. Elements of hearing aid 500A also shown in FIG. 5 in a cross-sectional view include a battery 508 and a vent hole 507.

In the illustrated embodiment, communication circuit 318 includes a radio circuit implemented on an integrated circuit chip. Primary antenna element 413 and communication circuit 318 are housed in case 505. Inductor 421 includes a wire wrapped chip inductor or a wire loop. Tuning capacitor 422 include a variable capacitor with a capacitance that is programmable or otherwise adjustable. Secondary antenna elements 414 (showing two secondary antenna elements 414A-B as an example) are incorporated into case 505. Secondary antenna elements 414A-B include detached wire loops (inductors 425) each clasped with a single capacitor 426. In various embodiments, inductors 425 may each be formed using any conductive element, such as conductive polymer, copper tape, or conductive ink. The loops (inductors 425) function as electromagnetic resonators tuned to a frequency specified by the inductance of inductor 425 and capacitance of capacitor 426.

Figure 5B:
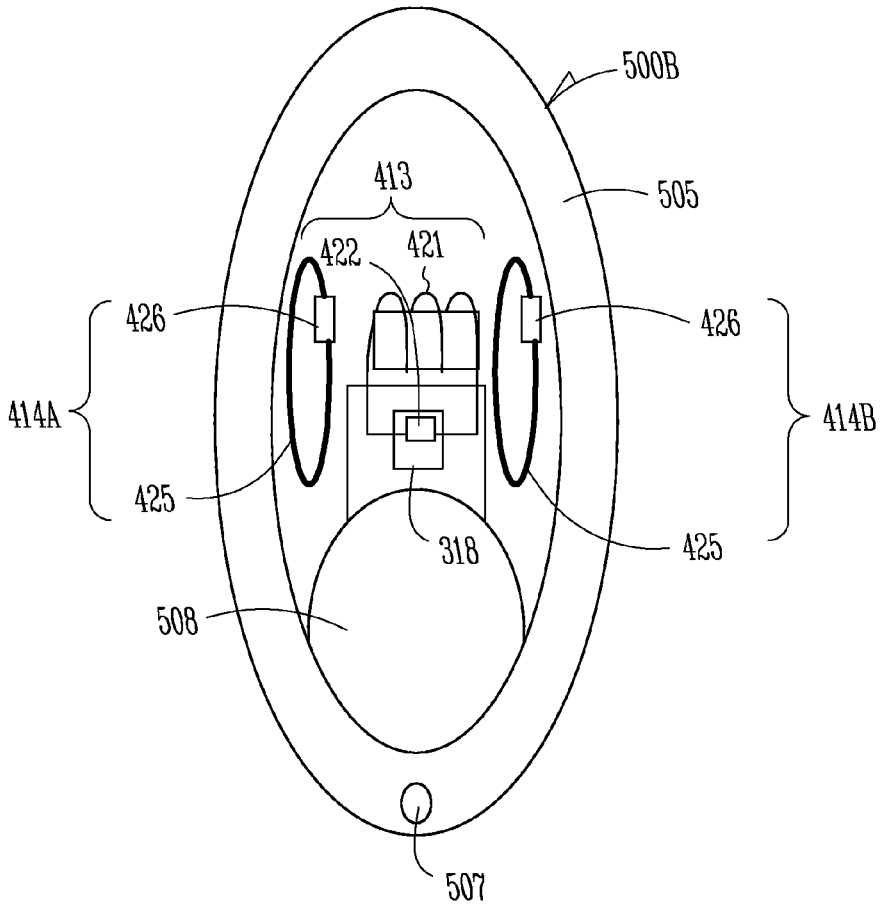
FIG. 5B is an illustration of another embodiment of the antenna and communication circuit of FIG. 4.

FIG. 5B is an illustration of another embodiment of antenna 412 and communication circuit 318 housed in case 505 of a hearing aid 500B. Hearing aid 500B represents another embodiment of hearing aid 100. Hearing aid 500B differs from hearing aid 500A in that secondary antenna elements 414 (showing two secondary antenna elements 414A-B as an example) are housed in case 505. In one embodiment, secondary antenna elements 414 are wrapped around a portion of circuitry of hearing aid 500B. This wrapped portion of circuitry may include a battery, a receiver, or any one or more components of hearing aid 500B. In another embodiment, secondary antenna elements 414 and primary antenna element 413 are integrated onto one of more flexible circuit of hearing aid 500B. The secondary antenna elements 414 and primary antenna element 413 may be inductively coupled to each other through dielectric between the flexible circuits. In another embodiment, secondary antenna elements 414 are integrated onto a layer of a flexible circuit of hearing aid 500B, while primary antenna element 413 is integrated onto another layer of the flexible circuit and inductively coupled to secondary antenna element 412 through the dielectric between the layers of the flexible circuit.

Figure 6A:
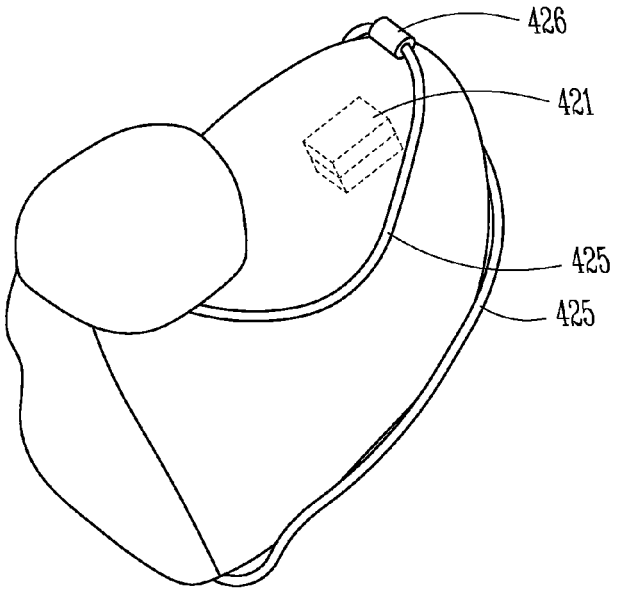
FIG. 6A is a picture showing an embodiment of the hearing aid with antenna elements incorporated into the case.
Figure 6B:
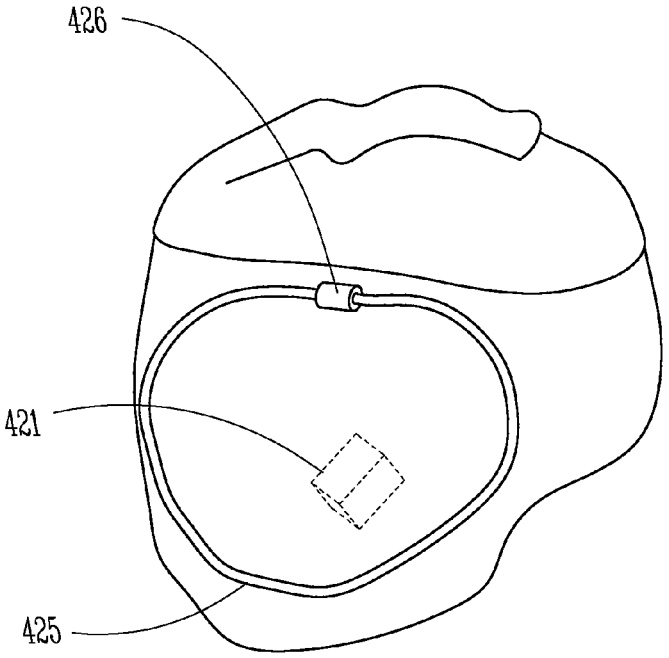
FIG. 6B is a picture showing another embodiment of the hearing aid with antenna elements incorporated into the case.

In various embodiments in which secondary antenna elements 414 are incorporated into case 505, secondary antenna elements 414 may be affixed to the surface of case 505 and/or embedded in case 505. FIG. 6A is a picture showing an embodiment of a hearing aid (such as hearing aid 200 or 500A) with a chip inductor (such as inductor 421) housed in the case (such as case 205 or 505) and wire loops (such as inductors 425) attached onto the surface of the case. FIG. 6B is a picture showing an embodiment of a hearing aid (such as hearing aid 200 or 500A) with a chip inductor (such as inductor 421) housed in the case (such as case 205 or 505) and wire loops (such as inductors 425) and a wire loop (such as inductor 425) and a tuning capacitor (such as capacitor 426) embedded in the case. For example, cased 505 may have groove(s) accommodating the secondary antenna element(s), and casing material is patch over the secondary antenna element(s) such that the secondary antenna element(s) is(are) embedded in case 505.

Figure 7A:
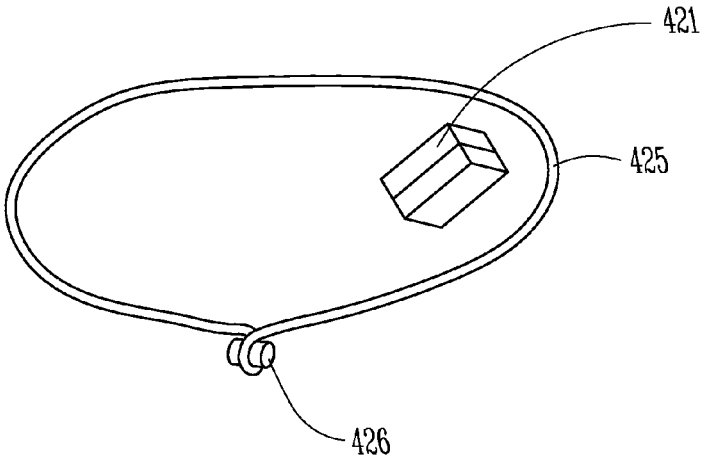
FIG. 7A is a picture showing an embodiment a circuit of the hearing aid.
Figure 7B:
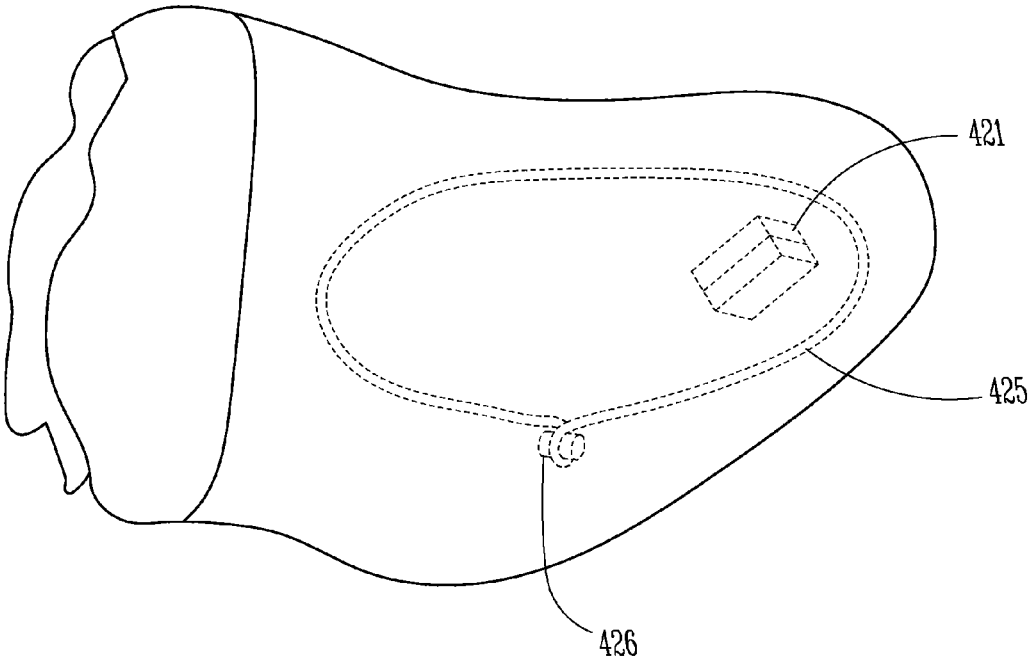
FIG. 7B is a picture showing the circuit of FIG. 7A housed in the hearing aid.
Figure 8:
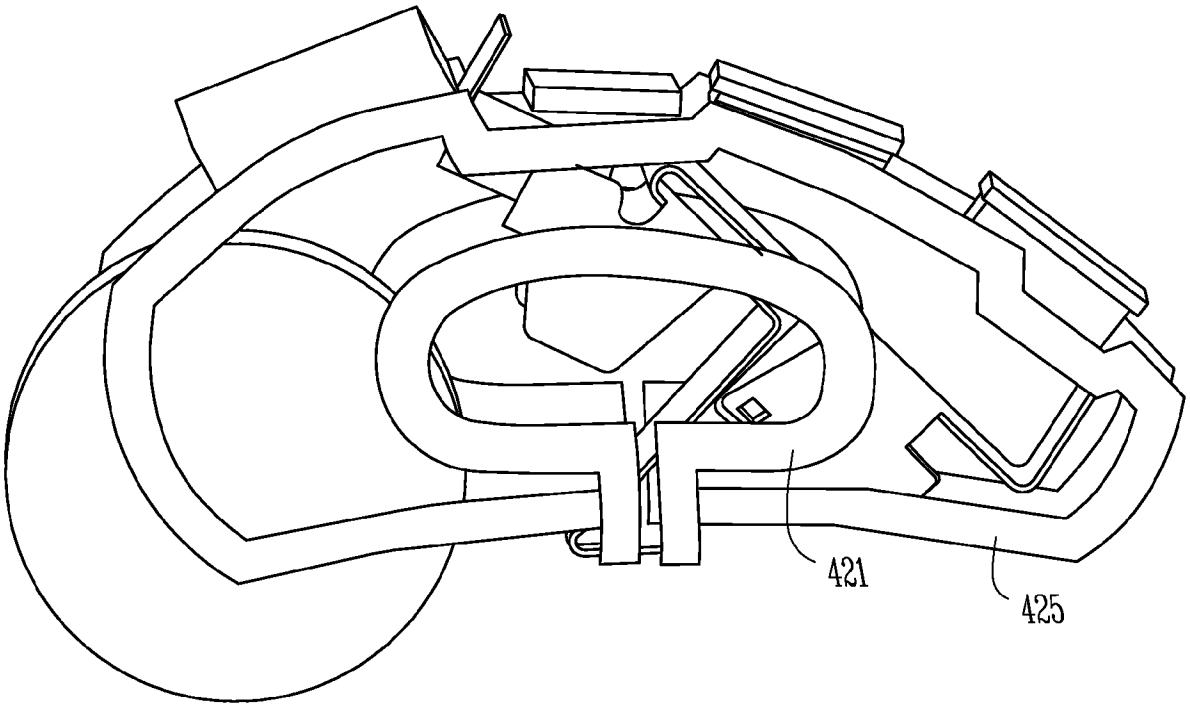
FIG. 8 is a picture showing another embodiment of a circuit of the hearing aid.

In various embodiments in which secondary antenna elements 414 are housed in case 505, secondary antenna elements 414 may wrap around a portion of a circuit also housed in case 505 or be formed on a flexible circuit substrate. FIG. 7A is a picture showing an embodiment a circuit of a hearing aid (such as hearing aid 500B), with a chip inductor (such as inductor 421) and a wire loop (such as inductor 425) and a tuning capacitor (such as capacitor 426). Wire loop 425 wraps around a substantial portion of the circuit. FIG. 7B is a picture showing the circuit and secondary antenna elements 414 both housed in the case (such as case 505) of the hearing aid. FIG. 8 is a picture showing another embodiment of portions of a circuit of a BTE type hearing aid with loop 425 formed on a layer of a flexible circuit and loop 421 formed on another layer of the flexible circuit. Loop 425 has a self-resonance set by distributed capacitance (as illustrated) or a chip capacitor. In various embodiments, such an antenna configuration limits out-of-band interference by providing a steep out of band rejection role off similar to a band-pass filter.

Figure 9:
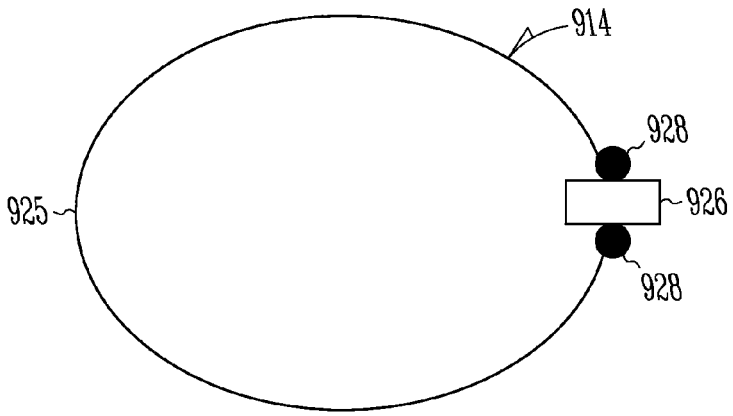
FIG. 9 is an illustration of an embodiment of a secondary antenna element of the antenna.

FIG. 9 is an illustration of an embodiment of a secondary antenna element 914 representing an embodiment of one element of secondary antenna element(s) 414. In the illustrated embodiment, secondary antenna element 914 is an electromagnetic resonator including an inductor 925 made of a length of wire or any other conductive material and clasped end to end with a capacitor 926 (such as a miniature chip capacitor). In one example, for a resonant frequency of about 900 MHz, inductor 925 is a loop formed using a segment of 30 AWG copper wire having a length of approximately one thirteenth of the wavelength ($\lambda/13$), and capacitor 926 is a 0.7 pF ceramic chip capacitor. Inductor 925 is connected to capacitor 926 by soldering at soldering spots 928.

Figure 10:
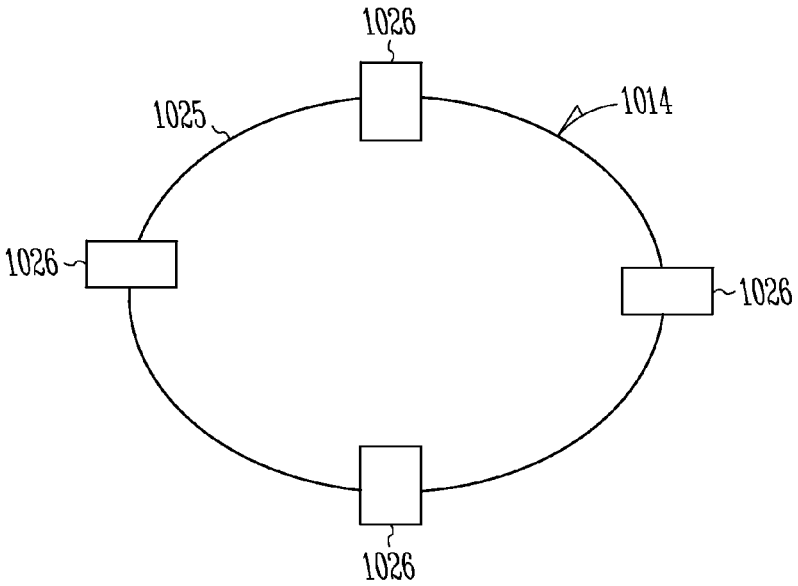
FIG. 10 is an illustration of another embodiment of a secondary antenna element of the antenna.

FIG. 10 an illustration of an embodiment of a secondary antenna element 1014 representing another embodiment of one element of secondary antenna element(s) 414. In the illustrated embodiment, secondary antenna element 1014 is an electromagnetic resonator including an inductor 1025 made of segments of a wire or any other conductive material each connected between two capacitors of a plurality of capacitors 1026 (such as miniature chip capacitors). Such a configuration may increase the radiation efficiency because the current density is stronger near each of capacitors 1026.

In various embodiments, the geometry of secondary antenna element(s) 414, including its various embodiments discussed in this document, are determined the frequency (or the corresponding wavelength, $\lambda$) of the operating frequency of the wireless communication. In one embodiment, each inductor 425 of secondary antenna element(s) 414 is made by meandering an open ended conductor of a length being approximately one half of the wavelength ($\lambda/2$), or multiples of this length ($m\lambda/2$, wherein m is an integer greater than 1). In another embodiment, each inductor 425 of secondary antenna element(s) 414 is made by forming a closed loop using a conductor of a length (circumference) being approximately one half of the wavelength ($\lambda/2$), or multiples of this length ($m\lambda/2$, wherein m is an integer greater than 1). In one embodiment, each inductor 425 of secondary antenna element(s) 414 is made by meandering an open ended conductor of a length being substantially less than one half of the wavelength ($\lambda/2$), or multiples of this length. An appropriate reactive element is placed in between ends of the conductor for the desired resonance frequency of secondary antenna element(s) 414. This reactive element may be an inductive element for a small resonator (though it is illustrated as capacitor 426). In another embodiment, each inductor 425 of secondary antenna element(s) 414 is made by forming a closed loop using a conductor of a length (circumference) being substantially less than one half of the wavelength ($\lambda/2$), or multiples of this length. An appropriate reactive element is placed in between ends of the conductor forming the loop for the desired resonance frequency of secondary antenna element(s) 414. This reactive element may be a capacitive element for a small resonator.

In various embodiments, when one or more loops are used for secondary antenna element(s) 414, the dominant transverse-magnetic (TM) mode of radiation decreases the loading effects of the predominantly dielectric loading of the skin and head of the hearing aid wearer, thus providing low variability in tuning among different hearing aid wearers. When primary antenna element 413 is housed inside case 505, and secondary antenna elements 414 are embedded in case 505, the dominant TM allows the electromagnetic field to couple through the dielectric plastics of case 505 with little loss or disruption to the near field energy. The difference between elements of secondary antenna elements 414 may provide the offset to the resonant frequencies (that increases the bandwidth of antenna 412 as discussed above). The plastic case 505 may also lower the Q of the secondary antenna elements 414 and/or increase the capacitive coupling between elements of secondary antenna elements 414, thereby shifting the resonant frequencies of the elements closer to each other.

In various embodiments, inductor 425 of secondary antenna element(s) 414 can be formed using any of a variety of conducting elements such as copper wire, coiled copper wire, copper trace on a flexible substrate, injection moldable conductive nylon polymer. Inductor 421 of primary antenna element 413 can include a loop or a chip inductor, and can include an embedded copper trace on flexible substrate or printed circuit board.

In various embodiments, capacitor 426 of secondary antenna element(s) 414 can include a ceramic chip capacitor or metal plates separated by air or any structure providing the needed capacitance. The capacitor may not be needed if inductor 425 is a loop having a circumference greater than one eight of the wavelength ($\lambda/8$). In one embodiment, capacitor 426 of can include an adjustable tuning capacitor to provide more control over adjusting for mutual capacitance changes and variations in packaging. In one embodiment, secondary antenna element(s) 414 can each be a simple LC tank resonator where L (inductor 425) and C (capacitor 426) include a chip inductor and a chip capacitor, respectively. Shape of the resonator can be smaller with higher capacitance or larger with lower capacitance. At higher frequencies, the resonator could be implemented on an integrated chip. A wire loop on an integrated chip also may be used to couple into an electromagnetic resonator instead of a spate ceramic component.

In various embodiments, each of secondary antenna element(s) 414 can be individually and optimally tuned for a specific environment (e.g., in air or in the ear). Secondary antenna element(s) 414 at resonance in any given environment are active radiators that may inherently be coupled to more tightly. Thus, the antenna system can be inherently and optimally pre-tuned to multiple environments without the need for situational retuning.

In various embodiments, the efficiency of antenna 412 can be maximized by using very high-Q detachable coil(s) as secondary antenna element(s) 414. The operational bandwidth antenna 412 can be decreased by increasing the Q of the secondary antenna element(s) 414. This undesired narrowing of the bandwidth can be mitigated by "stagger-tuning" the resonant frequency for each of the secondary antenna element(s) 414. In effect this would form a band-pass filter of wider bandwidth than each individual element of secondary antenna element(s) 414 (or all the elements if tuned to the same resonant frequency), thereby effectively providing a broad-band antenna system and allow operation over a significantly wider frequency range.

In various embodiments, in secondary antenna elements 414, one or more loops functioning as inductor 425 can each be orthogonally polarized (at right angles) relative to the other loop(s) functioning as inductor 425, thereby creating a polarization diversity. The feed inductor may need to be broken down into two orthogonal series or parallel inductors, or the feed network may switch between two orthogonal feed inductors to optimally couple to each orthogonally polarized loop. In one embodiment, antenna 412 includes multiple primary elements (or multiple inductors as primary antenna element 413) for effective coupling with secondary antenna elements 414 including the one or more loops each orthogonally polarized relative to the other loop(s).

In various embodiments, each element of secondary antenna elements 414 can be tuned to be resonant at a substantially different frequency to operate for a different frequency band. Thus, antenna 412 is configured as a multi-band antenna accommodating the wireless communication with signals transmitted from the hearing aid using different frequency bands.

Figure 11:
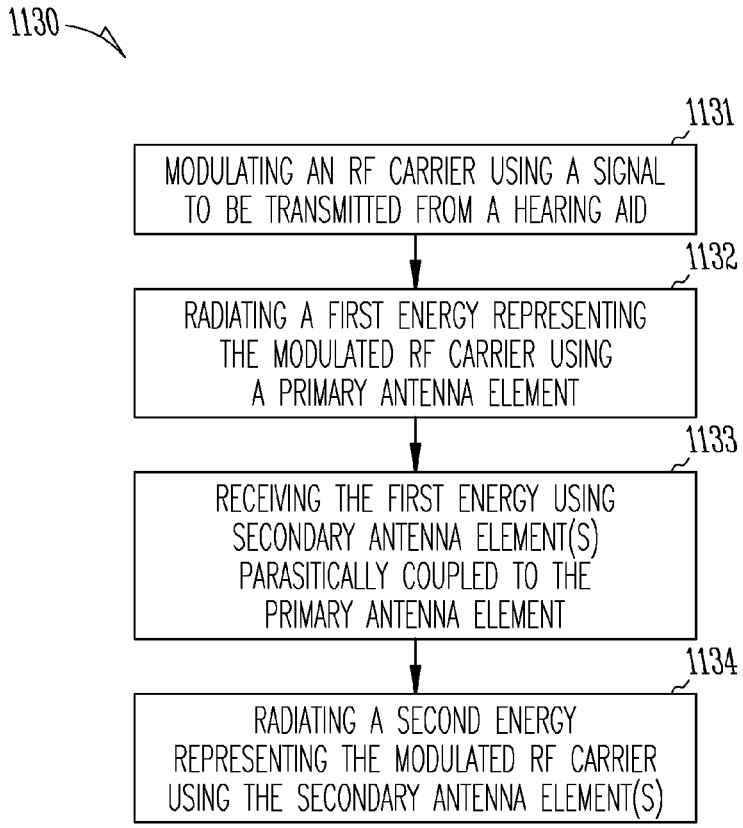
FIG. 11 is a flow chart illustrating a method for transmitting a signal from a hearing aid using wireless communication.

FIG. 11 is a flow chart illustrating a method 1130 for transmitting a signal from a hearing aid using wireless communication. In one embodiment, the method is performed by hearing aid 100 using antenna 412, including their various embodiments as discussed in this document.

At 1131, a radio frequency (RF) carrier is modulated using the signal to be transmitted from the hearing aid. At 1132, a near-filed electromagnetic energy representing the modulated RF carrier is radiated from a primary antenna element housed in the case of the hearing aid. Examples of the primary antenna element include primary antenna element 413, including its various embodiments as discussed in this document. At 1133, the near-filed electromagnetic energy is received by one or more secondary antenna elements that are parasitically coupled to the primary antenna element. Examples of the one or more secondary antenna elements include secondary antenna element(s) 414, including its (their) various embodiments as discussed in this document. At 1134, a far-field electromagnetic energy representing the modulated radio frequency carrier from the one or more second antenna elements, in response to reception of the near-filed electromagnetic energy. The far-field electromagnetic energy is to be received by a device communicating with the hearing aid via a wireless link. The device recovers and demodulates the modulated RF carrier to receive the signal.

In various embodiments, the primary antenna elements and the one or more secondary antenna elements can each be tuned for radiation efficiency and/or bandwidth for the wireless communication. For example, the one or more secondary antenna elements may each be tuned to have a standalone resonant frequency different from the resonant frequency of the primary antenna element by a specified offset, thereby increasing the bandwidth for the wireless communication. The one or more secondary antenna elements may each be tuned to have a standalone resonant frequency higher or lower than the resonant frequency of the primary antenna element by a specified offset, thereby increasing the bandwidth for the wireless communication and/or increasing radiation power when the hearing aid is in placed in its operational position in the hearing aid wearer.

In various embodiments, the secondary antenna elements can be configured such that methods 1130 can be performed for transmitting different signals using different frequency bands and/or for transmitting signals with a broader frequency band. For example, multiple secondary antenna elements can be tuned to be resonant at substantially different frequencies to accommodate the wireless communication with signals transmitted from the hearing aid using different frequency bands and/or to increase operational bandwidth for the wireless communication. Multiple secondary antenna elements can also be arranged into groups each including one or more secondary antenna elements and tuned to have substantially different standalone resonant frequencies to provide for a plurality of substantially different frequency bands for the wireless communication and/or an increased operational bandwidth for the wireless communication. Elements of each group of secondary antenna elements can be tuned to be resonant at substantially different frequencies to increase operational bandwidth of the group. The difference between resonant frequencies associate with the elements of each group may be small when compared to the resonance frequency of the group.

In various embodiments, the present subject matter facilitates miniaturization of wireless hearing aids and improves antenna performance by reducing deteriorating effects of human body loading. The various antenna configuration as discussed in this document are relatively easy to implement and visually examined after manufacturing.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid capable of performing wireless communication with another device, the hearing aid comprising:
- a case;
- a hearing aid circuit housed in the case, the hearing aid circuit configured to perform the wireless communication; and
- an antenna including:
  - a primary antenna element wired to the hearing aid circuit; and
  - one or more secondary antenna elements wirelessly coupled to the primary antenna element and configured to receive near field electromagnetic energy radiated from the primary antenna and to radiate far field electromagnetic energy to communicate with the other device.

2. The hearing aid of claim 1, wherein the one or more secondary antenna elements are incorporated into the case.

3. The hearing aid of claim 1, wherein at least a portion of the hearing aid circuit is constructed as one or more flexible circuits, and the primary antenna element and the one or more second antenna elements are formed on the one or more flexible circuits.

4. The hearing aid of claim 1, wherein the one or more secondary antenna elements are housed in the case and wrapped around a portion of the hearing aid circuit.

5. The hearing aid of claim 1, wherein the primary antenna element comprises a primary radiation element configured to energize the one or more secondary antenna elements, and the secondary antenna elements each comprises a passive electromagnetic resonant repeater.

6. The hearing aid of claim 5, wherein the primary antenna element comprises an inductor and a capacitor.

7. The hearing aid of claim 6, wherein the one or more secondary antenna elements each comprise an inductor and a capacitor.

8. The hearing aid of claim 7, wherein the capacitor of the primary antenna element comprises an adjustable capacitor.

9. A hearing aid capable of performing wireless communication with another device, the hearing aid comprising:
- a case;
- a hearing aid circuit housed in the case, the hearing aid circuit configured to perform the wireless communication; and
- an antenna including:
  - a primary antenna element wired to the hearing aid circuit; and
  - one or more secondary antenna elements parasitically coupled to the primary antenna element,
  - wherein the one or more secondary antenna elements are each tuned to have a standalone resonant frequency different from a resonant frequency of the primary antenna element by a specified offset.

10. The hearing aid of claim 9, wherein the one or more secondary antenna elements comprise a plurality of secondary antenna elements tuned to be resonant at substantially different frequencies.

11. The hearing aid of claim 9, wherein the one or more secondary antenna elements comprise a plurality of groups each including one or more elements of the one or more secondary antenna elements, the groups having substantially different standalone resonant frequencies.

12. The hearing aid of claim 11, wherein the one or more elements of each group of the plurality of groups comprise a plurality of elements tuned to be resonant at substantially different frequencies.

13. The hearing aid of claim 1, wherein the case is configured for an invisible-in-the-ear hearing aid.

14. A hearing aid capable of performing wireless communication with another device, the hearing aid comprising:
- a case;
- a hearing aid circuit housed in the case, the hearing aid circuit configured to perform the wireless communication; and
- an antenna including:
  - a primary antenna element electrically coupled to the hearing aid circuit; and
  - one or more secondary antenna elements each embedded in or affixed to the case and configured to be inductively coupled to the primary antenna element to receive near field electromagnetic energy from the primary antenna element.

15. The hearing aid of claim 14, wherein the antenna element comprises a wire wrapped chip inductor.

16. The hearing aid of claim 14, wherein the primary antenna element comprises a conductive loop.

17. The hearing aid of claim 14, wherein the one or more secondary antenna elements comprise an antenna element made by meandering an open ended conductor of a length being approximately one half of a wavelength used in the wireless communication or multiples of the one half of the wavelength.

18. The hearing aid of claim 14, wherein the one or more secondary antenna elements each comprise a conductive loop.

19. A hearing aid capable of performing wireless communication with another device, the hearing aid comprising:
- a case;
- a hearing aid circuit housed in the case, the hearing aid circuit configured to perform the wireless communication; and an antenna including:

a primary antenna element electrically coupled to the hearing aid circuit; and one or more secondary antenna elements each embedded in or affixed to the case and configured to be inductively coupled to the primary antenna element, wherein the one of more secondary antenna elements each comprise a conductive loop and a secondary capacitor connected to the conductive loop.

20. The hearing aid of claim 19, wherein the one of more secondary antenna elements each comprise an antenna element made of a segment of wire or other conductive material clasped end to end with the secondary capacitor.

21. The hearing aid of claim 19, wherein the one of more secondary antenna elements each comprise segments of a wire or other conductive material and a plurality of secondary capacitors, the segments each connected between two secondary capacitors of the plurality of secondary capacitors.

22. The hearing aid of claim 18, wherein the conductive loop comprises a conductor having a length of approximately one half of a wavelength used in the wireless communication or multiples of the one half of the wavelength.

23. A hearing aid capable of performing wireless communication with another device, the hearing aid comprising:

a case;

a hearing aid circuit housed in the case, the hearing aid circuit configured to perform the wireless communication; and an antenna including:

a primary antenna element electrically coupled to the hearing aid circuit; and one or more secondary antenna elements each embedded in or affixed to the case and configured to be inductively coupled to the primary antenna element, wherein the one or more secondary antenna elements comprise a plurality of loops each orthogonally polarized relative to the other one or more loops of the plurality of loops.

24. A method for transmitting a signal from a hearing aid using wireless communication, the method comprising:

modulating a radio frequency carrier using the signal;

radiating a near field electromagnetic energy representing the modulated radio frequency carrier from a primary antenna element housed in a case of the hearing aid;

receiving the near field electromagnetic energy using one or more secondary antenna elements parasitically coupled to the primary antenna element, the one or more secondary antenna elements incorporated into the case or housed in the case; and radiating a far field electromagnetic energy representing the modulated radio frequency carrier from the one or more second antenna elements.

25. A method for transmitting a signal from a hearing aid using wireless communication, the method comprising:

modulating a radio frequency carrier using the signal;

radiating a first energy representing the modulated radio frequency carrier from a primary antenna element housed in a case of the hearing aid;

receiving the first energy using one or more secondary antenna elements parasitically coupled to the primary antenna element, the one or more secondary antenna elements incorporated into the case or housed in the case;

radiating a second first energy representing the modulated radio frequency carrier from the one or more second antenna elements; and tuning the one or more secondary antenna elements such that the one or more secondary antenna elements each have a standalone resonant frequency different from a resonant frequency of the primary antenna element by a specified offset.

26. A method for transmitting a signal from a hearing aid using wireless communication, the method comprising:

modulating a radio frequency carrier using the signal;

radiating a first energy representing the modulated radio frequency carrier from a primary antenna element housed in a case of the hearing aid;

receiving the first energy using one or more secondary antenna elements parasitically coupled to the primary antenna element, the one or more secondary antenna elements incorporated into the case or housed in the case and including a plurality of secondary antenna elements;

radiating a second first energy representing the modulated radio frequency carrier from the one or more second antenna elements; and tuning the secondary antenna elements to be resonant at substantially different frequencies.

27. A method for transmitting a signal from a hearing aid using wireless communication, the method comprising:

modulating a radio frequency carrier using the signal;

radiating a first energy representing the modulated radio frequency carrier from a primary antenna element housed in a case of the hearing aid;

receiving the first energy using one or more secondary antenna elements parasitically coupled to the primary antenna element, the one or more secondary antenna elements incorporated into the case or housed in the case and including a plurality of secondary antenna elements, and further comprising;

radiating a second first energy representing the modulated radio frequency carrier from the one or more second antenna elements; and arranging the plurality of secondary antenna elements into a plurality of groups each including one or more elements of the plurality of secondary antenna elements, the groups having substantially different standalone resonant frequencies.

28. The method of claim 27, wherein the one or more elements of each group of the plurality of groups comprise a plurality of elements, and further comprising tuning elements of the plurality of elements to be resonant at substantially different frequencies.

* * * * *